US005374498A

United States Patent [19]

Fujita et al.

[11] Patent Number: 5,374,498

[45] Date of Patent: Dec. 20, 1994

[54] SILVER HALIDE PHOTOGRAPHIC LIGHT-SENSITIVE MATERIAL

[75] Inventors: Akio Fujita; Takeo Arai, both of Hino, Japan

[73] Assignee: Konica Corporation, Japan

[21] Appl. No.: 61,310

[22] Filed: May 13, 1993

[30] Foreign Application Priority Data

May 27, 1992 [JP] Japan ..... 4-135206

[51] Int. Cl.[5] ..... G03C 1/06

[52] U.S. Cl. ..... 430/264; 430/598; 430/628; 430/642; 430/950; 430/539

[58] Field of Search ..... 430/264, 598, 628, 642, 430/950, 539

[56] References Cited

U.S. PATENT DOCUMENTS

| | | | |
|---|---|---|---|
| 5,004,669 | 4/1991 | Yamada et al. | 430/264 |
| 5,026,632 | 6/1991 | Bagchi et al. | 430/628 |
| 5,066,572 | 11/1991 | O'Connor et al. | 430/539 |
| 5,158,856 | 10/1992 | Usagawa et al. | 430/264 |
| 5,238,800 | 8/1993 | Hosoi et al. | 430/264 |

FOREIGN PATENT DOCUMENTS

| | | | |
|---|---|---|---|
| 383283 | 8/1990 | European Pat. Off. | G03C 1/053 |
| 0477670 | 9/1991 | European Pat. Off. | . |
| 477670 | 4/1992 | European Pat. Off. | G03C 1/04 |

OTHER PUBLICATIONS

Research Disclosure, No. 195 19551, Jul. 1980, Kenneth Mason Publications, Ltd.

*Primary Examiner*—Thomas R. Neville
*Attorney, Agent, or Firm*—Jordan B. Bierman

[57] ABSTRACT

A silver halide photographic light-sensitive material is disclosed. The light-sensitive material comprises a support having thereon a silver halide emulsion layer, wherein the silver halide emulsion layer contains a hydrazine derivative, and at least one of the silver halide emulsion layer and another hydrophilic colloid layer provided on the emulsion layer-coated side of the support contains a latex comprising polymer particles stabilized with gelatin.

7 Claims, No Drawings

SILVER HALIDE PHOTOGRAPHIC LIGHT-SENSITIVE MATERIAL

FIELD OF THE INVENTION

The present invention relates to a super-high-contrast silver halide photographic light-sensitive material, and more particularly to a silver halide photographic light-sensitive material which is excellent in the preservability and well restrained from producing possible black spots.

BACKGROUND OF THE INVENTION

The photomechanical process includes a step of transforming a continuous-gradation original image into a halftone-dot image, to which have so far been applied a super-high-contrast image reproducing photographic technique that employs an infectious development.

The emulsion of a lith-type silver halide light-sensitive material for use in the infectious development is a high-silver-chloride-content (at least 50 mol %) silver chlorobromide emulsion comprising uniformly shaped silver halide grains having an average grain size of about 0.2 μm with a narrow grain size distribution. The lith-type silver halide light-sensitive material, when processed in an alkaline hydroquinone developer solution having a low sulfite ion concentration, i.e., a lith-type developer solution, can provide an image having a high contrast, a high sharpness and a high resolution.

The lith-type developer solution, however, is unpreservable because it is subject to degradation by oxidation, so it is difficult to keep its developability constant when used continuously.

There is known a method capable of rapidly forming a high-contrast image without using such a lith-type developer solution; for example, a method in which a hydrazine derivative is incorporated into the silver halide photographic light-sensitive material as described in JP O.P.I. No. 106244/1981. According to this technique, contrasty images can be obtained even by using a well preservable developer solution for rapid processing.

For halftone-dot-quality improvement there is a technique to incorporate a redox compound into the light-sensitive material as disclosed in JP O.P.I. No. 285340/1990. For wider halftone gradation JP O.P.I. No. 174143/1991 discloses a light-sensitive material comprising a redox compound-containing layer and a hydrazine derivative-containing light-sensitive emulsion layer.

However, the use of such redox compounds has problems to cause the light-sensitive material's sensitivity and contrast to deteriorate with storage time and pepper fog, so-called black spots, to appear on the processed unexposed area of the light-sensitive material, so it is the status quo that any satisfactory characteristics have not yet been obtained to date.

SUMMARY OF THE INVENTION

It is an object of the invention to provide a super-high-contrast image forming method which is capable of preventing the light-sensitive material's sensitivity and contrast from deteriorating with storage time and of restraining black spots from appearing on the processed unexposed area of the light-sensitive material.

The above object of the invention is accomplished by a silver halide photographic light-sensitive material comprising a support having thereon a silver halide emulsion layer, in which the silver halide emulsion layer contains a hydrazine derivative, and at least one of the silver halide emulsion layer and another hydrophilic colloid layer provided on the emulsion layer-coated side of support contains a latex comprising polymer particles stabilized with gelatin.

DETAILED DESCRIPTION OF THE INVENTION

The hydrazine derivative used in the invention is preferably represented by the following Formula H:

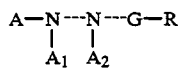

Formula H wherein

A represents an aryl group or a heterocyclic group containing at least either one of a sulfur atom and an oxygen atom;

G is a

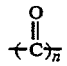

group, a sulfonyl group, a sulfoxy group, a

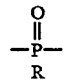

group or an iminomethylene group;

n is an integer of 1 or 2;

$A_1$ and $A_2$ each represent a hydrogen atom or either one of them is a hydrogen atom, while the other is a substituted or unsubstituted alkylsulfonyl group or a substituted or unsubstituted acyl group;

R is a hydrogen atom, an alkyl group, an aryl group, an alkoxy group, an aryloxy group, an amino group, a carbamoyl group, an oxycarbonyl group or a —O—$R_4$ group, wherein $R_4$ represents an alkyl group or a saturated heterocyclic group.

The hydrazine derivative further preferably includes ones represented by the following Formulas A and B:

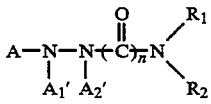

Formula A

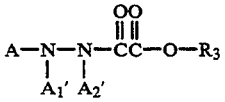

Formula B

In the above formulas, A represents an aryl group or a heterocyclic group containing at least either one of a sulfur atom and an oxygen atom; n is an integer of 1 or 2, provided that when n is 1, $R_1$ and $R_2$ each are a hydrogen atom, an alkyl group, an alkenyl group, an alkynyl group, an aryl group, a heterocyclic group, an hydroxy group, an alkoxy group, an alkenyloxy group, an alkynyloxy group, an aryloxy group or a heterocyclic oxy group, wherein $R_1$ and $R_2$ may form a ring together with a nitrogen atom, while when n is 2, $R_1$ and $R_2$ each are a hydrogen atom, an alkyl group, an alkenyl group, an alkynyl group, an aryl group, a saturated or unsaturated heterocyclic group, a hydroxy group, an alkoxy group, an alkenyloxy group, an alkynyloxy group, an aryloxy group or a heterocyclic oxy group, provided that when n is 2, at least either one of $R_1$ and $R_2$ is an alkenyl group, an alkynyl group, a saturated heterocyclic group, a hydroxy group, an alkoxy group, an alkenyloxy group, an alkynyloxy group, an aryloxy group or a heterocyclic oxy group; and $R_3$ is an alkynyl group or a saturated heterocyclic group $A_1'$ and $A_2'$ each represent a hydrogen atom, provided that either one of the hydrogen atoms represented by $A_1'$ and $A_2'$ may be substituted by a substituted or unsubstituted sulfonyl group, a substituted or unsubstituted acyl group or a substituted or unsubstituted oxalyl group.

To be more preferable, A is an aryl group such as phenyl or naphthyl, or a heterocyclic group containing at least one sulfur or oxygen atom, such as thiophene, furan, benzothiophene or pyrane.

$R_1$ and $R_2$ each are a hydrogen atom; an alkyl group such as methyl, ethyl, methoxyethyl, cyanoethyl, hydroxyethyl, benzyl or trifluoroethyl; an alkenyl group such as allyl, butenyl, pentenyl or pentadienyl; an alkynyl group such as propargyl, butynyl or pentynyl; an aryl group such as phenyl, naphthyl, cyanophenyl or methoxyphenyl; a heterocyclic group including an unsaturated heterocyclid group such as pyridine, thiophene or furan and a saturated heterocyclic group such as tetrahydrofuran or sulfofuran; a hydroxy group; an alkoxy group such as methoxy, ethoxy, benzyloxy or cyanomethoxy; an alkenyloxy group such as allyloxy or butenyloxy; an alkynyloxy group such as propargyloxy or butynyloxy; an aryloxy group such as phenoxy or naphthyloxy; or a heterocyclic oxy group such as pyridyloxy or pyrimidyloxy. When n represents 1, $R_1$ and $R_2$ may form together with a nitrogen atom a ring such as piperidine, piperazine or morpholine.

When n is an integer of 2, at least either one of $R_1$ and $R_2$ is an alkenyl group, an alkynyl group, a saturated heterocyclic group, a hydroxy group, an alkoxy group, an alkenyloxy group, an alkynyloxy group, an aryloxy group or a heterocyclic oxy group.

Examples of the alkynyl group and saturated heterocyclic group represented by $R_{,3}$ include those as exemplified in the above.

One of various substituents may be introduced to the aryl group or heterocyclic group having at least one sulfur or oxygen atom, represented by Formula A. Examples of the introducible substituent include a halogen atom, an alkyl group, an aryl group, an alkoxy group, an aryloxy group, an acyloxy group, an alkylthio group, an arylthio group, a sulfonyl group, an alkoxycarbonyl group, an aryloxycarbonyl group, a carbamoyl group, a sulfamoyl group, an acyl group, an amino group, an alkylamino group, an arylamino group, an acylamino group, a sulfonamido group, arylaminothiocarbonylamino group, a hydroxy group, a carboxy group, a sulfo group, a nitro group and cyano group. The preferred among these substituents is a sulfonamido group.

In each of the above formulas, A contains preferably at least either one nondiffusible group or silver halide adsorption accelerating group. The nondiffusible group is preferably a ballast group that is usually used in an immobile photographic additive such as a coupler. The ballast group is a relatively photographically inert group having 8 or more carbon atoms, and may be selected from among such groups as an alkyl group, an alkoxy group, a phenyl group, an alkylphenyl group, a phenoxy group and an alkylphenoxy group.

Examples of the silver halide adsorption accelerating group include the thiourea, thiourethane, heterocyclic thioamido, mercapto heterocyclic and triazole groups described in U.S. Pat. No. 4,385,108.

In Formulas A and B, either one of the hydrogen atoms represented by $A_1'$ and $A_2'$ may be substituted by substituents including sulfonyl groups such as methanesulfonyl and toluenesulfonyl; acyl groups such as acetyl, trifluoroacetyl and ethoxycarbonyl; and oxalyl groups such as ethoxalyl and pyruvoyl. Thus, the compounds represented by Formulas A and B include those having the above substituents. The hydrogen atoms represented by $A_1'$ and $A_2'$ are not substituted at the same time.

More preferred compounds in the invention are the compound of Formula A where n=2 and the compound of Formula B.

In the compound of Formula A where n=2, $R_1$ and $R_2$ each are a hydrogen atom, an alkyl group, an alkenyl group, an alkynyl group, an aryl group, a saturated or unsaturated heterocyclic group, a hydroxy group or an alkoxy group. The compound is more preferred in the case where at least one of $R_1$ and $R_2$ is an alkenyl group, an alkynyl group, a saturated heterocyclic group, a hydroxy group or an alkoxy group.

The following are typical examples of the compounds represented by Formulas A and B.

Exemplified compounds

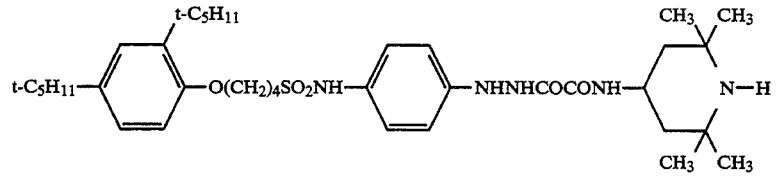

H-1

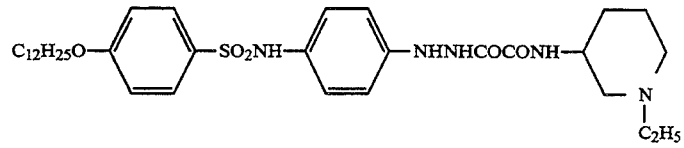

H-2

-continued
Exemplified compounds
H-3
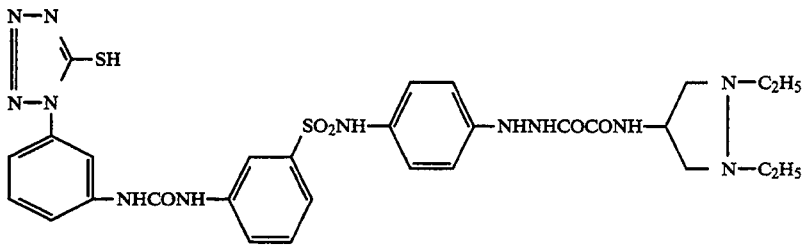
H-4
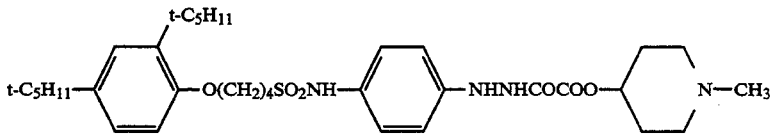
H-5
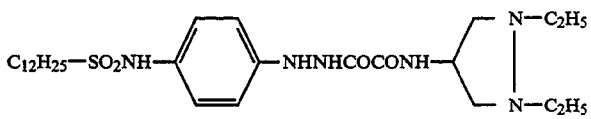
H-6
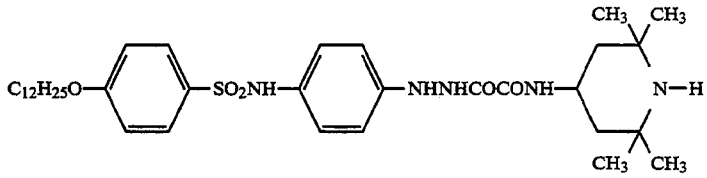
H-7
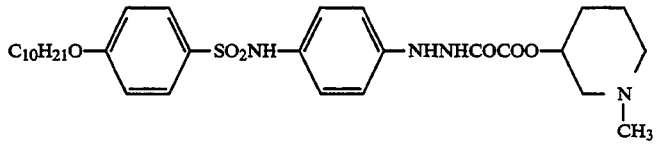
H-8
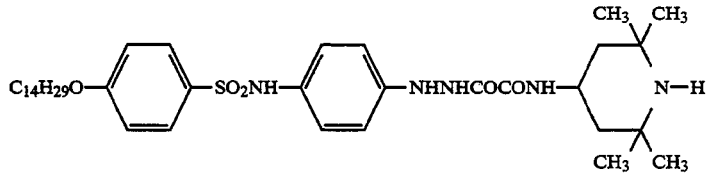
H-9
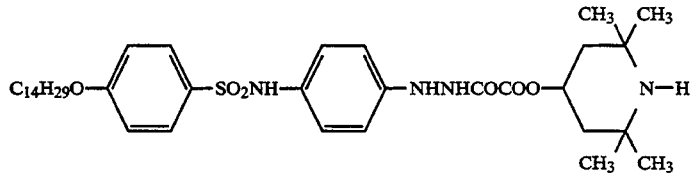
H-10
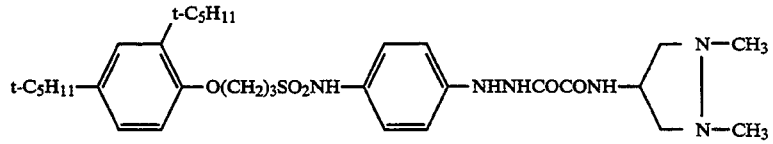
H-11
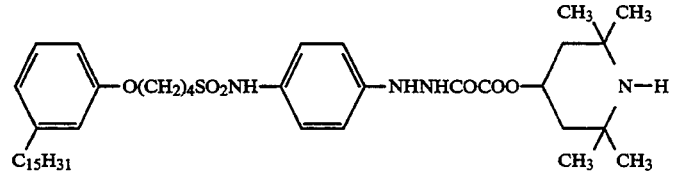

-continued

Exemplified compounds

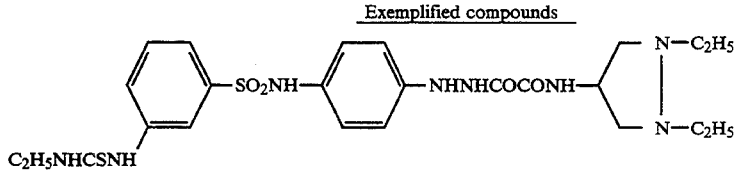

H-12

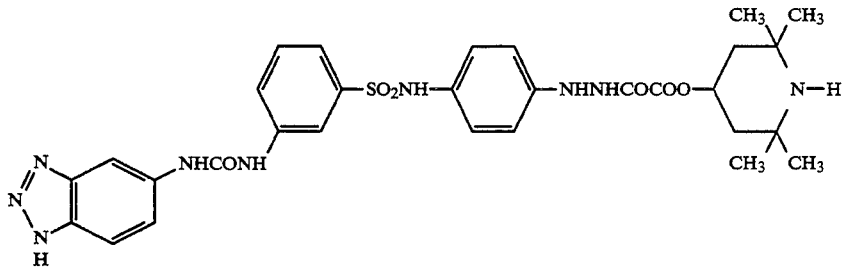

H-13

The polymer latex stabilized with gelatin applicable to the invention is a polymer latex whose surface and/or inside is stabilized by dispersing gelatin therethrough. It is preferable that the polymer and gelatin to constitute a latex be bound with a specific linkage; in this case, the polymer and gelatin may be linked either directly or through a crosslinking agent.

The polymer latex of the invention can be prepared by having at least part of its polymerization reaction progress in the presence of gelatin, and/or adding gelatin and a crosslinking agent after completion of the polymerization reaction to the latex before its mixing in a coating liquid. In the case where gelatin is added to stabilize the latex after its polymerization reaction, it is preferable to add a crosslinking agent for forming a bridge structure of gelatin or between gelatin and another polymer. Where the polymerization reaction takes place in the presence of gelatin, a crosslinking agent may be either present or absent. It is preferable to use a crosslinking agent for the reaction between gelatin and a polymer latex synthesized in a surfactant. Further, it can also be obtained by making gelatin present during the latex's polymerization reaction of the latex; this provides rather better results than the above method. In the latter, a surfactant may not be used during the polymerization reaction, but if necessary, the adding amount thereof is at most 0.1 to 3.0%, and preferably 0.1 to 1.5% of the polymer component. The preferred embodiment of the invention is the polymerization reaction of the polymer being carried out in the presence of a surface active agent in 0.1 to 3.0% by weight and gelatin in 2.0 to 20% by weight of the polymer. In the process of our continued investigation for light-sensitive materials' physical property improvement, we, the inventors, have found that there exists a specific boundary in the adding amount ratio between gelatin and the latex.

The gelatin/polymer ratio at the time of the synthesis is preferably 1:100 to 2:1, more preferably 1:50 to 1:2, further preferably 1:50 to 1:3, and most preferably 1:20 to 1:5.

The average particle size of the polymer latex stabilized with gelatin in the invention is in the range of preferably 0.005 to 1 μm, and more preferably 0.02 to 0.5 μm.

Examples of the polymer latex stabilized with gelatin include those hydrates of vinyl polymers derived from acrylates, methacrylates, styrenes, etc., as described in U.S. Pat. Nos. 2,772,166, 3,325,286, 3,411,911, 3,311,912 and 3,525,620; and Research Disclosure No. 195 19551 (July, 1980).

Examples of the polymer moiety of the gelatin-stabilized polymer latex suitably usable in the invention include alkylmethacrylate homopolymers such as of methylmethacrylate, ethylmethacrylate; styrene homopolymers; copolymers of alkyl methacrylate or styrene with acrylic acid, N-methylolacrylamide, glycidolmethacrylate; homopolymers of alkyl acrylates such as methyl acrylate, ethyl acrylate, butyl acrylate; copolymers of alkyl acrylates with acrylic acid, N-methylol acrylamide, copolymerizable component such as acrylic acid is preferably up to 30% by weight; butadiene homopolymers; copolymers of butadiene with one or more of styrene, butoxymethylacrylamide and acrylic acid; and vinylidene chloride/methyl acrylate/acrylic acid three-component copolymer. Among these polymers, ones having a glass transition point of not more than 70° C., particularly not more than 40° C. are preferable.

Where the polymer's linkage with gelatin is made through a crosslinking agent, the monomers constituting the polymer latex preferably include those having a reactive group such as a carboxyl group, an amino group, an amido group, an epoxy group, a hydroxyl group, an aldehyde group, an oxazoline group, an ether group, an active ester group, a methylol group, a cyano group, an acetyl group or a group having an unsaturated carbon linkage. Further, where a crosslinking agent is used, the agent may be one that is commonly used as a crosslinking agent for gelatin, examples of which agent include aldehyde, glycol, triazine, epoxy, vinylsulfone, oxazoline, methacryl and acryl crosslinking agents. Besides, to further increase the stability of dispersion of the gelatin-stabilized polymer latex of the invention, as the monomer for constitutint the polymer latex there may be used 2-acrylamido-2-methylpropanesulfonic acid or a salt thereof. The adding amount of the monomer is preferably 0.5 to 20% by weight of the whole weight of the components to provide good results.

As the gelatin for use in stabilizing the polymer latex of the invention there may be used gelatin, gelatin derivatives, graft polymers of gelatin with other high molecular materials. In addition, there may also be used in combination other materials including proteins, sugar derivatives, cellulose derivatives, and synthetic homo- or copolymer hydrophilic colloids.

The gelatin used for the above purpose may be lime-treated gelatin or acid-treated gelatin, particularly such as of the type described in Bull. Soc. Sci. Phot. Japan, No. 16, p. 30 (1966), and may also be a hydrolyzed or enzyme-decomposed product of gelatin. As the gelatin derivative there may be used one of those obtained by the reaction of gelatin with various compounds such as acid halides, acid anhydrides, isocyanates, bromoacetic acid, alkanesulfones, vinylsulfonamides, maleimido compounds, polyalkylene oxides, epoxy compounds, etc. Examples of the gelatin derivative are described in U.S. Pat. Nos. 2,614,928, 3,132,945, 3,186,846 and 3,312,553, British Patent Nos. 861,414, 1,033,189 and 1,005,784, and Japanese Patent E.P. No. 26845/1967.

Hydrophilic colloids usable along with gelatin include the aforementioned protein such as albumin and casein; the cellulose derivative includes hydroxyethyl cellulose, carboxymethyl cellulose and cellulose sulfate; and the sugar derivative includes sodium alginate and starch derivatives.

The polymer latex stabilized with gelatin of the invention is preferably added to at least one hydrophilic colloid layer provided on the silver halide emulsion-coated side of the support, and more preferably added to both an emulsion and a non-light-sensitive hydrophilic colloid layer on the emulsion layer side of the support. The polymer latex may be further present in a hydrophilic colloid layer provided on the surface of the support opposite to the emulsion-coated side. Any conventionally known latex may be added to the invention's latex-containing layer and/or to a layer free of the invention's latex. In the case where both sides of the support contain the latex of the invention, the kind and content thereof in each side may be either the same or different.

The following are useful examples of the latex of the invention, wherein each is shown with its constituents ratio.

L-1

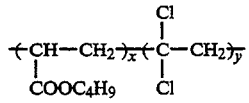

(x/y = 50/50)

L-2

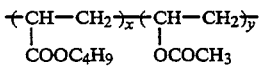

(x/y = 50/50)

L-3

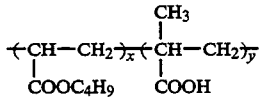

(x/y = 95.6/4.4)

L-4

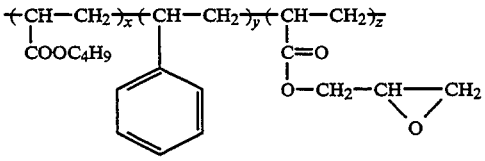

(x/y/z = 40/20/40)

L-5

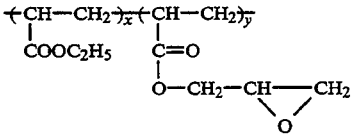

(x/y = 50/50)

L-6

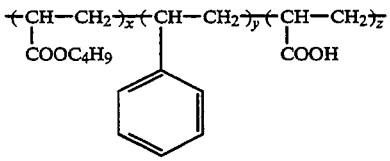

(x/y/z = 39.4/59/1.6)

L-7

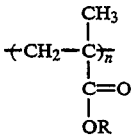

R: $-CH_3$, $C_2H_5$, $C_4H_9$

L-8

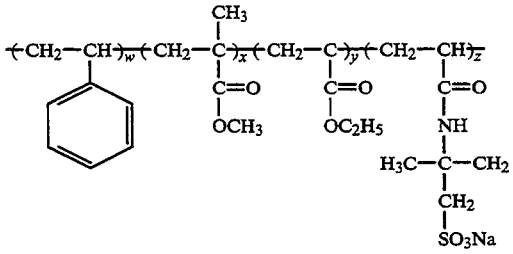

(w/x/y/z = 30/30/32/8)

L-9

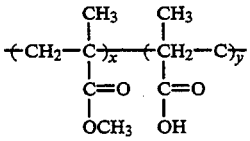

(x/y = 93/7)

L-10

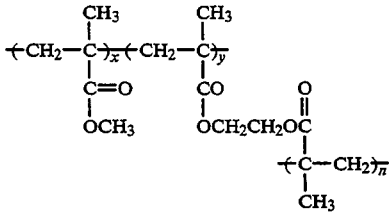

(x/y = 93/7)

-continued
L-11
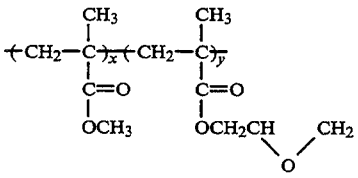
(x/y = 93/7)
L-12
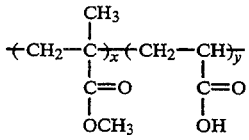
(x/y = 93/7)
L-13
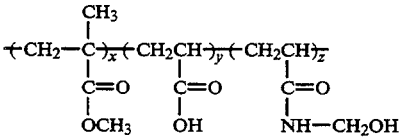
(x/y/z = 93/3/4)
L-14
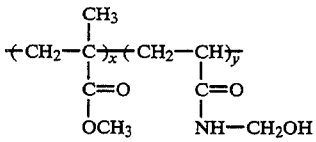
(x/y = 93/7)
L-15
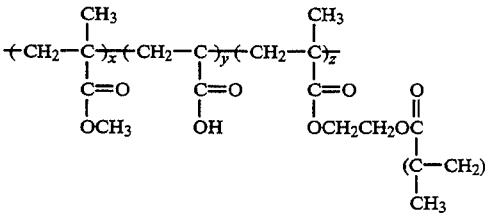
(x/y/z = 93/3/4)
L-16
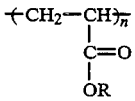
R: $-CH_3$, $-C_2H_5$, $-C_4H_9$
L-17
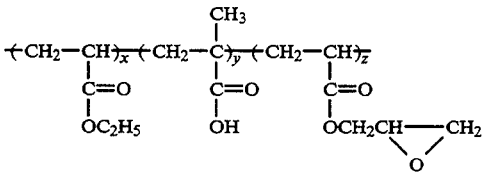
(x/y/z = 93/3/4)
L-18
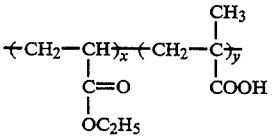
(x/y = 93/7)
L-19
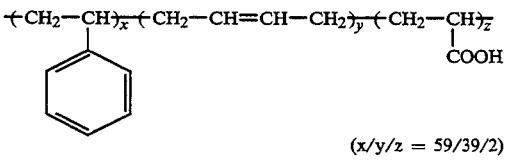
(x/y/z = 59/39/2)
L-20
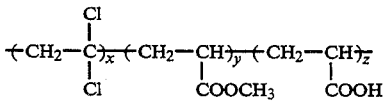
(x/y/z = 85/13/2)
L-21
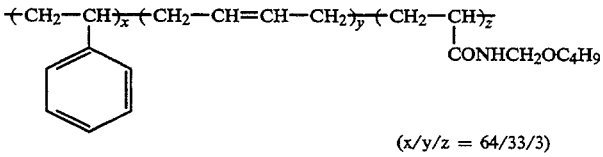
(x/y/z = 64/33/3)
L-22
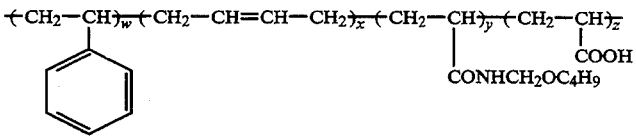
(w/x/y/z = 63/32/3/2)
L-23
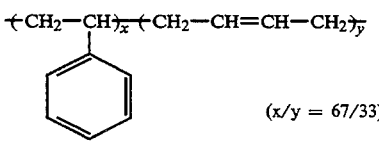
(x/y = 67/33)
L-24
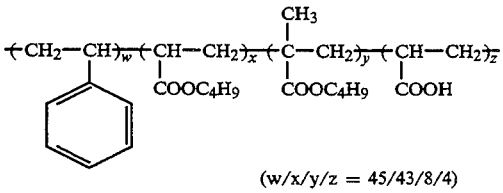
(w/x/y/z = 45/43/8/4)

-continued

L-25

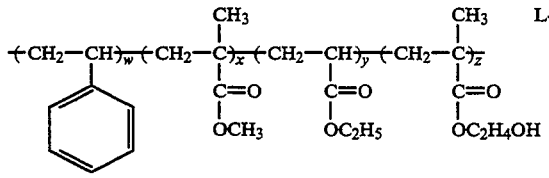

(w/x/y/z = 30/30/32/8)

L-26

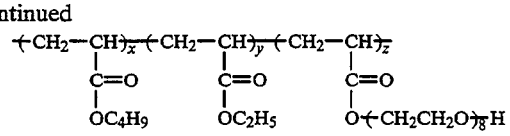

(x/y/z = 40/52/8)

The light-sensitive material of the invention may have one or more antistatic layers on the backing side and/or emulsion layer side of the support.

In this instance, the surface resistivity of the antistatic layer-provided side of the support is preferably not more than $1.0\times10^{11}\Omega$, and more preferably not more than $8\times10^{11}\Omega$ at 25° C./50%.

The above antistatic layer is preferably one containing a water-soluble conductive polymer, hydrophobic polymer particles and reaction product of a hardener or one containing a metal oxide.

The above water-soluble conductive polymer is a polymer having at least a conductive group selected from the class consisting of a sulfonic acid group, a sulfate group, a quaternary ammonium salt group, tertiary ammonium salt group, carboxyl group and a polyethylene oxide group. The preferred among these are the sulfonic acid group, sulfate group and quaternary ammonium salt group. The water-soluble conductive polymer requires a conductive group in an amount of 5% by weight or more per mol of the polymer. The water-soluble conductive polymer contains a carboxyl, hydroxy, amino, epoxy, aziridine, active methylene, sulfinic acid, aldehyde or vinylsulfon group. Of these groups, the carboxyl, hydroxy, amino, epoxy, aziridine and aldehyde groups are preferred. These groups are required to be contained in an amount of not less than 5% by weight per mol of the polymer. The number average molecular weight of the water-soluble conductive polymer is preferably 3000 to 100000, and more preferably 3500 to 50000.

Useful examples of the aforementioned metal oxide include tin oxide, indium oxide, antimony oxide, zinc oxide, vanadium oxide, and materials produced by doping these metal oxides with metallic silver, metallic phosphorus and metallic indium. The average particle size of these metal oxides is preferably $1\mu$ to $0.01\mu$.

Useful examples of the matting agent used in the light-sensitive material of the invention include conventionally known ones, such as the silica described in Swiss Patent No. 330,158; the glass powders described in French Patent No. 1,296,995; the inorganic particles such as of alkaline earth metals or carbonates of cadmium, zinc, etc., described in British Patent No. 1,173,181; the starch described in U.S. Pat. No. 2,322,037; the starch derivatives described in Belgian Patent No. 625,451 and British Patent No. 981,198; the polyvinyl alcohol described in JP E.P. No. 3643/1969; the polystyrene or polymethyl methacrylate described in Swiss Patent No. 330,158; the polyacrylonitrile described in U.S. Pat. No. 3,079,257; and the polycarbonated described in U.S. Pat. No. 3,022,169.

These matting agents may be used alone or in combination. The matting agent is preferably in the regular form of spherical particles, but is allowed to take other irregular forms such as the forms of tabular particles, cubic particles, and the like. The matting agent particle size is expressed in terms of the diameter of a sphere equivalent in the volume to the particle. The term 'matting agent particle size' in this specification implies the above spherical-equivalent diameter.

In the light-sensitive material of the invention, the outmost layer on the emulsion side preferably contains 4 mg to 80 mg/m$^2$ of at least one type matting agent in the regular and/or irregular form particles having a diameter of not less than 4 $\mu$m, and more preferably also contains in combination 4 mg to 80 mg/m$^2$ of at least one type matting agent in the regular and/or irregular form particles having a diameter of less than 4 $\mu$m.

The incorporated condition of the matting agent in the outmost layer is preferably such that at least part of the matting agent is in the outmost layer, while the rest of the agent allowed to reach the underneath layer.

In order to carry out the function of the matting agent, it is preferable that the matting agent in part come out on the surface of the outmost layer. The exposed part of the matting agent, however, may be either a portion of or the whole of its amount added. The incorporation of the matting agent may be made either by coating a layer-coating liquid having the matting agent in advance dispersed therein or in the manner that after coating a layer-coating liquid, the matting agent is sprayed onto the coated layer before completion of its drying. Where a plurality of different matting agents are to be added, both the above manners may be used in combination. Production techniques for more effectively adding these matting agents to the light-sensitive material are described in Japanese Patent Application No. 228762/1989.

The light-sensitive material of the invention has a subbing layer on its support. Examples of the subbing layer applicable to the invention include the subbing layer formed from an organic solvent containing those polyhydroxybenzenes described in JP O.P.I. No. 3972/1974; the subbing layer formed from those aqueous latexes described in JP O.P.I. Nos. 11118/1974, 104913/1977, 19941/1984, 19940/1984, 18945/1984, 112326/1976, 117617/1976, 58469/1976, 114120/1976, 121323/1976, 123139/1976, 114121/1976, 139320/1977, 65422/1977, 109923/1977, 119919/1977, 65949/1980, 128332/1982 and 19941/1984; and the subbing layer formed from those vinylidene chloride compounds described in U.S. Pat. Nos. 2,698,23, 2,779,684, 425,421 and 4,645,731.

The subbing layer may be subjected to chemical or physical surface treatment, i.e., surface activation treatment such as treatment with chemicals, mechanical treatment, corona-discharge treatment, flame treatment, UV treatment, high-frequency treatment, glow-discharge treatment, active-plasma treatment, laser treatment, mixed-acid treatment or ozone-oxidation treatment. The subbing layer is distinguished from the coating layers in the scope of the invention, and is free from any restrictions.

However, the embodiment of the invention can exhibit its effect very significantly when coating is made on a vinylidene chloride subbing layer-provided polyester base support.

In the invention, in addition to ordinary water-soluble dyes there may be incorporated a solid-dispersed dye in a specific hydrophilic colloid layer; the layer may be the outmost layer on the emulsion layer side, a layer underneath the emulsion layer and/or backing layer for the antihalation purpose. Also, one or more kinds of it may be added in an appropriate amount to one or more emulsion layers for the anti-irradiation purpose.

The adding amount range of the solid dispersed dye is preferably 5 mg to 1 g/m$^2$, and more preferably 10 mg to 800 mg/m$^2$ per kind thereof.

The solid-dispersed dye particles for the invention can be obtained in the manner that the dye is pulverized by means of a pulverizer such as a ball mill or sand mill, and then dispersed in water or a hydrophilic colloid such as gelatin, along with a surface active agent such as sodium dodecylbenzenesulfonate, sodium fluorooctylbenzenesulfonate, saponin or nonylphenoxypolyethylene glycol.

Useful compounds as the dye for the invention are those represented by the Formulas I to V described in U.S. Pat. No. 4,857,446.

The invention is applicable to various light-sensitive materials such as those for graphic arts use, X-ray use, general negative use, general reversal use, general positive use and direct positive use, and it can provide a very remarkable effect particularly when applied to light-sensitive materials for graphic arts use that requires high dimensional stability.

The silver halide photographic light-sensitive material of the invention is developed at a temperature of preferably not higher than 50° C., more preferably 25° C. to 40° C., for a period of normally within 2 minutes. Satisfactory results can be obtained particularly when the light-sensitive material is subjected to a 5 to 60-second rapid processing.

EXAMPLES

Example 1

Synthesis of Comparative Latex A

To a solution of 0.01 kg of sodium dodecylbenzenesulfonate and 0.05 kg of ammonium persulfate dissolved in 40 liters of water were added with stirring at a temperature of 60° C. spending an hour under a nitrogen atmosphere (a) 3.0 kg of styrene, (b) 3.0 kg of methyl methacrylate, (c) 3.2 kg of ethyl acrylate and (d) 0.8 kg of 2-acrylamido-2-methylpropanesulfonic acid. The mixture was subjected to stirring for 1.5 hours and then steam distillation for an hour to remove the residual monomers therefrom. After that, it was cooled to room temperature and pH of it was adjusted to 6.0 with use of sodium hydroxide. Water was added to make the whole of the obtained latex 55 kg, whereby a monodisperse latex having an average particle size of 0.11 μm was obtained.

Synthesis of Inventive Latex Lx-8

To a solution of 1.0 kg of gelatin, 0.01 kg of sodium dodecylbenzenesulfonate and 0.05 kg of ammonium persulfate dissolved in 60 liters of water were added with stirring at a temperature of 60° C. spending an hour under a nitrogen atmosphere (a) 3.0 kg of styrene, (b) 3.0 kg of methyl methacrylate, (c) 3.2 kg of ethyl acrylate and (d) 0.8 kg of sodium 2-acrylamido-2-methylpropanesulfonate. The mixture was subjected to stirring for 1.5 hours and steam distillation for 1 hour to remove the residual monomers therefrom. It was cooled to room temperature, and then pH of it was adjusted to 6.0, to thereby obtain a latex liquid. Water was added to make the whole of the latex 7 kg, whereby a monodisperse latex having an average particle size of 0.1 μm was obtained.

Synthesis of Inventive Latex Lx-17

To a solution of 0.01 kg of sodium dodecylbenzenesulfonate and 0.05 kg of ammonium persulfate dissolved in 40 liters of water were added with stirring at a temperature of 80° C. spending an hour under a nitrogen atmosphere a mixed liquid of (a) 9.3 kg of ethyl acrylate, (b) 0.4 kg of a product of the reaction between epichlorohydrine and acrylic acid and (c) 0.3 kg of acrylic acid. The mixture was stirred for 1.5 hours, 1.0 kg of gelatin and 0,005 kg of ammonium persulfate were added thereto and then further stirred for 1.5 hours to complete the reaction. After that it was subjected to steam distillation for one hour to remove the residual monomers therefrom, cooled to room temperature, and then pH of it was adjusted to 6.0 with use of ammonia. To the latex liquid obtained herein was added water to make the whole thereof 55 kg, whereby a monodisperse latex having an average particle diameter of 0.12 μm was obtained.

Preparation of a Support having a Conductive Layer

A polyethylene terephthalate base of 100μ in thickness, subbed as shown in JP O.P.I. No. 19941/1984 and corona-discharged at 10 W/(m$^2$.min), was used to coat thereon the following coating liquids by using a roll fit coating pan and an air-knife so as to have their coating amount of 10 ml/m$^2$. The drying of it was made at a temperature of 90° C. for 30 seconds in a parallel airflow having an overall coefficient of heat transfer of 25 kcal/(m$^2$.hr.° C.). The dry thickness and the surface resistivity of the coated layer at 23° C./55% were 1μ and $1\times10^8\Omega$, respectively.

| | |
|---|---|
| Water-soluble conductive polymer | 70 g/liter |

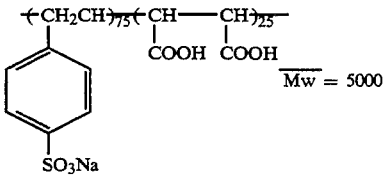

| | |
|---|---|
| Hydrophobic polymer particles | 40 g/liter |

-continued

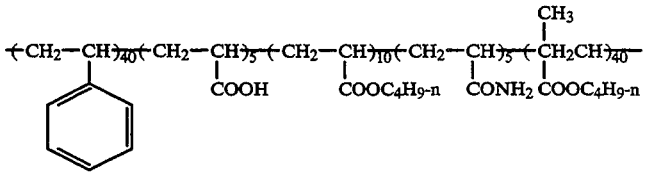

| | |
|---|---|
| Ammonium sulfate | 0.5 g/liter |
| Polyethylene oxide compound (average molecular weight: 600) | 6 g/liter |
| Hardening agent, a mixture of | 12 g/liter |

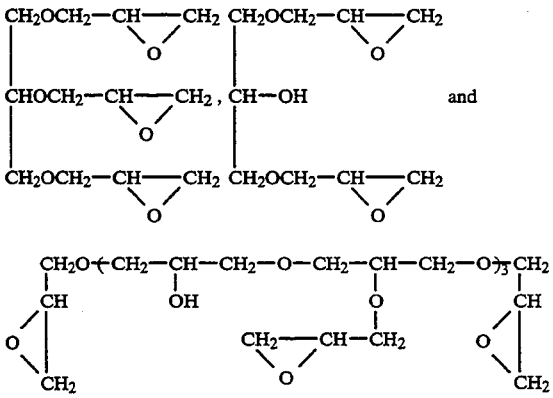

Preparation of Silver Halide Photographic Emulsion A

A silver iodobromide emulsion (silver iodide content: 2 mol % per mol of silver) was prepared by use of a double-jet process. In the course of this process $K_2IrCl_6$ was added in an amount of $8\times10^{-7}$ mol per mol of silver. The obtained emulsion was of monodisperse cubic grains having an average grain size of 0.20 μm. This emulsion was washed in the usual manner for desalting. The desalted emulsion's pH at 40° C. was 8.0. The process was followed by adding to the emulsion an aqueous potassium iodide solution in 0.1 mol % per mol of silver to make conversion of the grain surface, then adding Sensitizing Dyes D-1 and D-2 in 200 mg and 10 mg, respectively, per mol of silver, and further adding a mixture of Compounds A, B and C, whereby an Emulsion A was prepared.

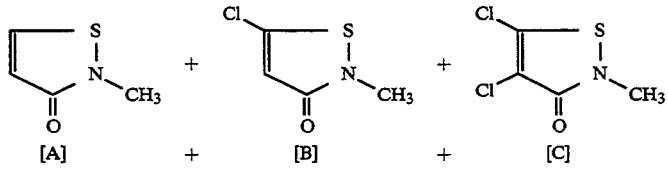

Sensitizing dye D-1

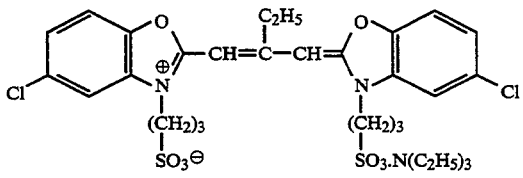

Sensitizing dye D-2

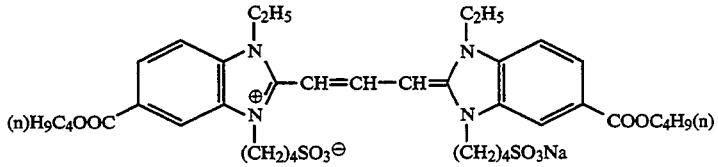

Preparation of a Silver Halide Photographic Light-Sensitive Material

On the above-prepared conductive layer a light-sensitive silver halide emulsion layer having a composition according to the following Prescription (1) was coated so as to have a gelatin coating weight of 2.0 g/m² and a silver coating weight of 3.2 g/m²; and on this was further coated an emulsion protective layer according to Prescription (2) so as to have a gelatin coating weight of 1.0 g/m²; while on the other side subbing layer was coated a backing layer according to Prescription (3) so as to have a gelatin coating weight of 2.4 g/m$^2$, and on this was coated a backing protective layer according to Prescription (4) so as to have a gelatin coating weight of 1 g/m$^2$. The light-sensitive material samples prepared in above are collectively shown in Table 1.

Prescription (1) Light-sensitive Silver Halide Emulsion Composition

| | |
|---|---|
| Gelatin | 2.0 g/m$^2$ |
| Silver halide Emulsion A, silver equivalent | 3.2 g/m$^2$ |
| Stabilizer: 4-methyl-6-hydroxy-1,3,3a,7-tetrazaindene | 30 mg/m$^2$ |
| Antifoggant: Adenine, 1-phenyl-5-mercapto-tetrazol | 10 mg/m$^2$ |
| Surfactant: sodium dodecylbenzenesulfonate | 0.1 g/m$^2$ |
| Surfactant: S-1 | 8 mg/m$^2$ |

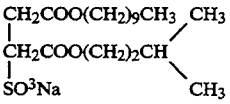

| | |
|---|---|
| Hydrazine derivative H-1 | $1 \times 10^{-5}$ mol/m$^2$ |
| Polymer latex | Amount given in Table 2 |
| Polyethylene glycol (molecular weight: 4000) | 0.1 g/m$^2$ |
| Hardener HA-1 | 60 mg/m$^2$ |

-continued

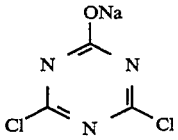

Prescription (2) Emulsion Protective Layer Composition

| | |
|---|---|
| Gelatin | 0.9 g/m$^2$ |
| Surfactant S-2 | 10 g/m$^2$ |

| | |
|---|---|
| Surfactant S-3 | 10 mg/m$^2$ |

| | |
|---|---|
| Matting agent (monodisperse silica having average particle size of 3.5 μm) | 3 mg/m$^2$ |
| Hardener: 1,3-vinylsulfonyl-2-propanol | 40 mg/m$^2$ |
| Polymer latex | Amount given in Table 1 |

Prescription (3) Backing Layer Composition (a) 30 mg/m$^2$

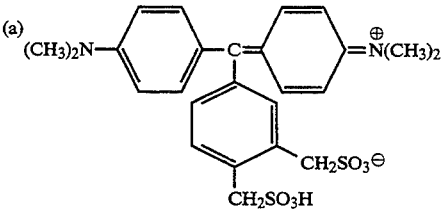

(b) 75 mg/m$^2$

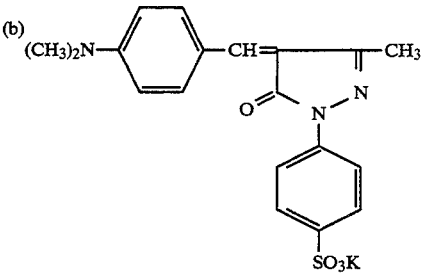

(c) 30 mg/m$^2$

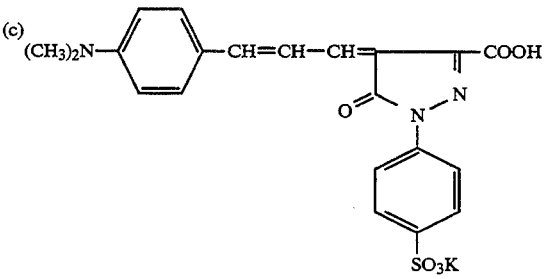

| | |
|---|---|
| Gelatin | 2.4 g/m$^2$ |
| Surfactant: Sodium dodecylbenzenesulfonate | 0.1 g/m$^2$ |
| Surfactant: S-1 | 6 mg/m$^2$ |

-continued

| | |
|---|---|
| Colloidal silica | 100 mg/m$^2$ |

Hardener

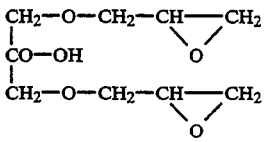

Prescription (4) Backing Protective Layer Composition

| | |
|---|---|
| Gelatin | 1 g/m$^2$ |
| Matting agent: Monodisperse polymethyl methacrylate (average particle size: 5.0 μ) | 50 mg/m$^2$ |
| Surfactant S-2 | 10 mg/m$^2$ |

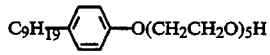

| | |
|---|---|
| Hardener: Glyoxal | 25 mg/m$^2$ |
| Hardener HA-1 | 35 mg/m$^2$ |

TABLE 1

| Sample No. | Emulsion layer LX type | Emulsion layer g/m$^2$ | Protective layer LX type | Protective layer g/m$^2$ |
|---|---|---|---|---|
| 1 (Comp.) | — | — | — | — |
| 2 (Comp.) | A | 0.5 | — | — |
| 3 (Comp.) | A | 0.5 | A | 0.5 |
| 4 (Inv.) | LX-17 | 0.5 | — | — |
| 5 (Inv.) | LX-17 | 0.5 | — | — |
| 6 (Inv.) | LX-18 | 0.5 | — | — |
| 7 (Inv.) | LX-18 | 0.5 | LX-8 | 0.5 |

Each of the obtained samples was exposed for five seconds through an optical stepwedge to 3200° K. tungsten light, and then processed in a developer and a fixer of the following compositions by using an automatic processor GR-26SR for rapid processing, manufactured by KONICA Corp.

Each sample, after being allowed to stand for 24 hours under conditions of 23° C./50% RH, was packed in a hermetically sealed container for tests: one of them was stored for 3 days at room temperature (Storage I) and the other was subjected to accelerated aging test (Storage II) for 3 days at 55° C. The aged samples also were exposed and processed in like manner.

Processing Conditions

The processing conditions used are as follows:

| Developer | |
|---|---|
| Sodium hydrogensulfite | 40 g |
| N-methyl-P-aminophenol sulfate | 350 mg |
| Disodium ethylenediaminetetraacetate | 1 g |
| Sodium chloride | 5 g |
| Potassium bromide | 1.2 g |
| Trisodium phosphate | 75 g |
| 5-Methylbenzotriazole | 250 mg |
| 2-Mercaptobenzothiazole | 23 mg |
| Benzotriazole | 83 mg |
| Hydroquinone | 29 g |
| Diisopropylaminoethanol | 2.3 ml |
| Amine compound Am-1 | 0.5 ml |

-continued

| | |
|---|---|
| Potassium hydroxide | for adjusting pH to 11.6 |
| Water to make 1 liter | |
| Amine Compound Am-1 | x = 2.6 (average) |

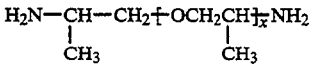

| Fixer | |
|---|---|
| Ammonium thiosulfate (59.5% w/v solution) | 830 ml |
| Disodium ethylenediaminetetraacetate | 515 mg |
| Sodium sulfite | 63 g |
| Boric acid | 22.5 g |
| Acetic acid (90% w/v solution) | 82 g |
| Citric acid (50% w/v solution) | 15.7 g |
| Gluconic acid (50% w/v solution) | 8.55 g |
| Aluminum sulfate (48% w/v solution) | 13 ml |
| Glutaraldehyde | 3 g |
| Sulfuric acid | for adjusting pH to 4.6 |
| Water to make 1 liter. | |

| Processing conditions: Step | Temperature | Time |
|---|---|---|
| Developing | 38° C. | 20 seconds |
| Fixing | 38° C. | 20 seconds |
| Washing | room temperature | 15 seconds |
| Drying | 40° C. | 15 seconds |

The time of each processing step includes the cross-over transporting period up to the subsequent step.

Each processed sample was subjected to density measurement with an optical densitometer KONICA PDA-65 to obtain its sensitivity and gamma, wherein the sensitivity of each sample was given in terms of a relative sensitivity to the sensitivity set at 100 of Sample No. 1, while the gamma was shown in terms of the tangent of the inclination formed between densities of 0.1 and 2.5. Regarding the gamma value, less than 6 is unacceptable; not less than 6 and less than 10 is still not sufficiently high contrast; and as high as 10 or more is well acceptable for providing a super-high contrast image.

Black spots in the unexposed area were examined for evaluation with use of a 40-power magnifier. A sample with no black spots at all was classified as '5', the highest rank, while the others having black spots were ranked '4', '3', '2' down to '1' as the number of black spots increases. The ranked '1' and '2' are those on unacceptable levels for practical use.

From the results shown in Table 2 it is understood that the samples for the invention show stable photographic characteristics with little or no black spots.

The results are shown in Table 2.

TABLE 2

| Sample No. | Latex polymer Type | Latex polymer Added to | Characteristics Storage I Rel. speed | Storage I Gamma value | Storage I Black spots | Storage II Rel. speed | Storage II Gamma value | Storage II Black spots |
|---|---|---|---|---|---|---|---|---|
| 1 (Comp.) | — | — | 100 | 8.0 | 2 | 140 | 5.0 | 1 |
| 2 (Comp.) | A | Emulsion layer | 110 | 9.5 | 2 | 150 | 6.0 | 1 |
| 3 (Comp.) | A | Em layer/pro layer | 115 | 10.0 | 3 | 160 | 7.5 | 2 |
| 4 (Inv.) | LX-17 | Emulsion layer | 100 | 13.0 | 4 | 105 | 12.5 | 4 |
| 5 (Inv.) | LX-17 | Em layer/pro layer | 105 | 13.5 | 5 | 110 | 13.0 | 5 |
| 6 (Inv.) | LX-8 | Emulsiom layer | 105 | 13.5 | 4 | 110 | 13.5 | 4 |
| 7 (Inv.) | LX-8 | Em layer/Pro layer | 110 | 14.0 | 5 | 110 | 14.0 | 5 |

Example 2

Preparation of a Support having a Conductive Layer

A subbed polyethylene terephthalate support of 100μ in thickness was subjected to corona discharge treatment, and then coated thereon with a conductive layer of the following composition.

| | |
|---|---|
| Gelatin | 35 mg/m$^2$ |
| $SnO_2$/Sb(8/2) (particle size: 0.3 μm) | 250 mg/m$^2$ |
| Surfactant: S-2 | 50 mg/m$^2$ |

The coated layer was dried at 90° C. for 2 minutes, and then subjected to heat treatment at 140° C. for 90 seconds.

A sample having the conductive layer on one side alone of its support was prepared.

The sample was prepared in quite the same manner as in Example 1, and the obtained sample was subjected to the same tests as in Example 1.

As a result, it is understood that the sample containing the latex of the invention shows less sensitivity change, less contrast reduction and less occurrence of black spots with lapse of time than those of a comparative sample free of the latex of the invention, thus providing satisfactory results.

Example 3

Preparation of Silver Halide Emulsion B

A silver chlorobromide emulsion having a silver chloride content of 70 mol % was prepared by double-jet process. During this process, $K_2IrCl_6$ and $K_2RhCl_6$ were added in amounts of $8\times10^{-6}$ and $1\times10^{-6}$ mol per mol of silver, respectively. The thus obtained emulsion was comprised of cubic monodisperse silver halide grains having an average grain size of 0.20 μm and a variation coefficient of grain size distribution of 9%. The emulsion was desalted in the usual manner. The desalted emulsion had a pH value of 8.0 at 40° C. A solution of potassium bromide in an amount of 0.1 mol % of silver was added to the emulsion to make its silver halide grain surface conversion, and then to the emulsion were added sensitizing dyes D-1 in 200 mg and D-2 in 10 mg per mol of silver and further a mixture of compounds A, B and C, whereby Emulsion B was obtained.

Preparation of Light-Sensitive Material Samples

The samples shown in Table 3 were prepared in the same manner as in Example 1 except that Emulsion B and the following hydrazine Compound H-14 were used in place of the Emulsion A and hydrazine Compound H-1, respectively, and the following Compounds D and E were added.

TABLE 3

| Sample No. | Latex in emulsion layer Type | Latex in emulsion layer g/m$^2$ | Latex in protective layer Type | Latex in protective layer g/m$^2$ | Hydrazine compound g/m$^2$ |
|---|---|---|---|---|---|
| 1 (Comp.) | — | — | — | — | — |
| 2 (Comp.) | — | — | — | — | Present |
| 3 (Comp.) | A | 0.5 | — | — | — |
| 4 (Comp.) | A | 0.5 | — | — | Present |
| 5 (Comp.) | A | 0.5 | A | 0.5 | — |
| 6 (Comp.) | A | 0.5 | A | 0.5 | Present |
| 7 (Comp.) | LX-17 | 0.5 | — | — | — |
| 8 (Inv.) | LX-17 | 0.5 | — | — | Present |
| 9 (Comp.) | LX-17 | 0.5 | LX-17 | 0.5 | — |
| 10 (Inv.) | LX-17 | 0.5 | LX-17 | 0.5 | Present |
| 11 (Comp.) | LX-8 | 0.5 | — | — | — |
| 12 (Inv.) | LX-8 | 0.5 | — | — | Present |
| 13 (Comp.) | LX-8 | 0.5 | LX-18 | 0.5 | — |
| 14 (Inv.) | LX-8 | 0.5 | LX-18 | 0.5 | Present |

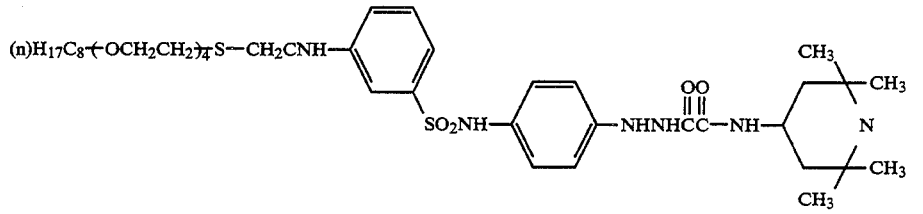

Compound D

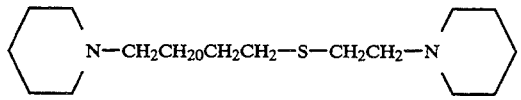

-continued

Compound E

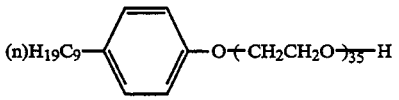

The thus prepared samples were evaluated in the same manner as in Example 1 except that the developer was replaced by the following one.

| | |
|---|---|
| Sodium sulfite | 55 g |
| Potassium carbonate | 40 g |
| 4-Methyl-4-hydroxymethyl-1-phenyl-3-hydrazolidone (Dimezone S) | 0.9 g |
| Potassium bromide | 5 g |
| 5-Methylbenzotriazole | 0.13 g |
| 1-Phenyl-5-mercaptotetrazole | 0.02 g |
| Boric acid | 2.2 g |
| Diethylene glycol | 40 g |
| Water to make | 1 liter |
| Adjust pH to 10.5 using potassium hydroxide. | |

The results obtained are given in Table 4.

TABLE 4

| Sample No. | Latex polymer Type | Latex polymer Added to | Hydrazine cpd H-14 | Characteristics Storage I Rel. speed | Storage I Gamma value | Storage I Black spots | Storage II Rel. speed | Storage II Gamma value | Storage II Black spots |
|---|---|---|---|---|---|---|---|---|---|
| 1 (Comp.) | — | — | — | 100 | 5.0 | 5 | 140 | 4.0 | 5 |
| 2 (Comp.) | — | — | Present | 150 | 10.0 | 2 | 220 | 7.0 | 1 |
| 3 (Comp.) | A | Emulsion layer | — | 100 | 5.0 | 5 | 150 | 4.0 | 5 |
| 4 (Comp.) | A | " | Present | 152 | 11.0 | 3 | 230 | 7.5 | 1 |
| 5 (Comp.) | A | Em layer/pro layer | — | 105 | 4.5 | 5 | 160 | 4.5 | 5 |
| 6 (Comp.) | A | " | Present | 160 | 11.0 | 3 | 235 | 9.0 | 2 |
| 7 (Comp.) | LX-17 | Emulsion layer | — | 103 | 5.0 | 5 | 137 | 5.0 | 5 |
| 8 (Inv.) | LX-17 | " | Present | 155 | 13.0 | 4 | 158 | 12.5 | 4 |
| 9 (Comp.) | LX-17 | Em layer/pro layer | — | 105 | 5.0 | 5 | 145 | 5.0 | 5 |
| 10 (Inv.) | LX-17 | " | Present | 160 | 13.5 | 5 | 164 | 13.5 | 5 |
| 11 (Comp.) | LX-8 | Emulsion layer | — | 100 | 4.5 | 5 | 138 | 4.5 | 5 |
| 12 (Inv.) | LX-8 | " | Present | 150 | 14.0 | 4 | 154 | 14.0 | 4 |
| 13 (Comp.) | LX-8 | Em layer/pro layer | — | 110 | 5.0 | 5 | 159 | 5.0 | 5 |
| 14 (Inv.) | LX-8 | " | Present | 165 | 14.0 | 5 | 168 | 14.0 | 5 |

From Table 4 it is understood that the samples which use the inventive latex/hydrazine compound combinations show less drop in the sensitivity, less increase in black spots and less lowering of the contrast than the comparative samples during their storage period.

What is claimed is:

1. A silver halide photographic light-sensitive material comprising a support, having provided on a single side thereof, a silver halide emulsion layer and a hydrophilic colloid layer, wherein said silver halide emulsion layer contains a hydrazine derivative, represented by Formula (A) or Formula (B), and at least one of said silver halide emulsion layer and said hydrophilic colloid layer contains a latex comprising polymer particles formed by polymerization in the presence of gelatin;

(A)

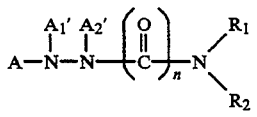

(B)

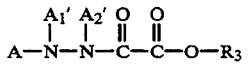

wherein

A is aryl or a heterocyclic containing a sulfur atom or an oxygen atom;

n is an integer of 1 or 2;

when n is 1, $R_1$ and $R_2$ are each hydrogen, alkyl, alkenyl, alkynyl, aryl, heterocyclic, hydroxy, alkoxy, alkenyloxy, alkynyloxy, aryloxy, or heterocycloxy, $R_1$ may be linked together with $R_2$ to form a ring including the nitrogen atom;

when n is 2, $R_1$ and $R_2$ are each hydrogen, alkyl, alkenyl, alkynyl, aryl, a saturated or unsaturated heterocyclic, hydroxy, alkoxy, alkenyloxy, alkynyloxy, aryloxy, or heterocycloxy, provided that at least one of $R_1$ and $R_2$ is alkenyl, alkynyl, saturated heterocyclic, hydroxy, alkoxy, alkenyloxy, alkynyl, aryloxy, or heterocycloxy;

$R_3$ is alkynyl or a saturated heterocyclic; $A_1'$ and $A_2'$ are each hydrogen or either one of them is hydrogen and the other is substituted or unsubstituted alkylsulfonyl, substituted or unsubstituted acyl, or substituted or unsubstituted oxalyl.

2. The light-sensitive material of claim 1, the ratio of gelatin to polymer at the formation of said latex is 1:100 to 2:1.

3. The light-sensitive material of claim 2, wherein the ratio of gelatin to polymer at the formation of said latex is 1:50 to 1:2.

4. The light-sensitive material of claim 3, wherein the ratio of gelatin to polymer at the formation of said latex is 1:50 to 1:3.

5. The light-sensitive material of claim 1, wherein said polymer particles have an average size of 0.005 μm to 1 μm.

6. The light-sensitive material of claim 5, wherein said polymer particles have an average size of 0.02 μm to 0.5 μm.

7. The light-sensitive material of claim 1, wherein said polymer latex is one in which the particles of polymer are formed by polymerization reaction performed in the presence of a surfactant in an amount of 0.1 to 3.0% by weight of said polymer and gelatin in an amount of 2.0 to 20% by weight of said polymer.

* * * * *